United States Patent [19]

Simmons et al.

[11] Patent Number: 4,885,887

[45] Date of Patent: Dec. 12, 1989

[54] APPARATUS AND METHOD FOR SECURING AN OUTER ROOFING MEMBRANE TO AN INSULATED ROOF DECK

[75] Inventors: Robert W. Simmons, Federal Way, Wash.; Richard W. Stamper, Lambertville, Mich.; Thomas P. Kaufman, Toledo, Ohio

[73] Assignee: GenCorp Inc., Fairlawn, Ohio

[21] Appl. No.: 359,825

[22] Filed: Jun. 1, 1989

Related U.S. Application Data

[63] Continuation of Ser. No. 191,949, May 9, 1988, abandoned.

[51] Int. Cl.[4] ..... E04B 7/00; E04B 5/00

[52] U.S. Cl. ..... 52/410; 52/746; 52/459

[58] Field of Search ..... 52/410, 746, 512, 459, 52/539, 511, 385, 509; 428/40

[56] References Cited

U.S. PATENT DOCUMENTS

| | | | |
|---|---|---|---|
| 259,228 | 6/1982 | Smith et al. | 52/459 |
| 2,599,359 | 6/1952 | Banks et al. | 428/40 |
| 3,270,473 | 9/1966 | Smith | 52/390 |
| 4,161,854 | 7/1979 | Stelzer | 52/309.1 |
| 4,162,597 | 7/1979 | Kelly | 52/410 |
| 4,712,348 | 12/1987 | Triplett | 52/410 |

*Primary Examiner*—James L. Ridgill, Jr.

[57] ABSTRACT

An apparatus and method for securing an outer roofing membrane to a roof deck includes a flat bar anchor strip and a bar anchor tape having successive layers of an optional primer, an adhesive and a protective layer.

28 Claims, 2 Drawing Sheets

APPARATUS AND METHOD FOR SECURING AN OUTER ROOFING MEMBRANE TO AN INSULATED ROOF DECK

This is a continuation of application Ser. No. 07/191/949, filed May 9, 1988, now abandoned.

FIELD OF THE INVENTION

The present invention relates to an apparatus and for a method of installing a roofing membrane which is securely adhered to a roof without the utilization of fasteners penetrating the membrane.

BACKGROUND OF THE INVENTION

A conventional roof deck can be constructed from plywood or any other approved material. An insulation barrier formed from fiberglass or some other approved insulation material can be added to the deck. Thereover, a weather-proof roofing membrane can be installed and secured in place to make the roof weather resistant. One apparatus for securing a roofing membrane utilizes a small, circular, metal plate having a hole in the center thereof and a roofing nail. In order to anchor the roofing membrane, the small, circular, metal plates are placed in rows at spaced positions on the roofing membrane and the nail is driven through the hole in each plate, the membrane, the insulation material and then into the roof deck. The roofing membrane sheets are secured in this matter at the seams, where two membrane sheets overlap, and also at the spaced locations on each roofing membrane sheet. Although the metal plate and nail apparatus securely anchor the roofing membrane, there exists a potential for a leak to develop at each location where the roofing membrane has been penetrated by a nail. Recognizing this problem, various methods and devices have been developed to either seal the roofing nails or screws that penetrate the roofing membrane or to affix the roofing membrane to the roof deck utilizing an apparatus and method which does not pierce the membrane. One disadvantage of the system that requires a sealing operation at each point where a roofing membrane is pierced by a fastener resides in the fact that such operations are necessarily time consuming, labor intensive and not conductive to rapid installation of a roofing membrane. Another disadvantage of such a system is that they utilize some type of adhesive fastener apparatus. A problem with some types of adhesive fasteners is that they do not lead themselves to rapid installation of a roofing membrane. Other types of adhesive fastening methods and apparatuses for securing roofing membranes do not adequately retain the roofing membrane on the roofing deck and therefore gravel or some type of ballast must-be placed on the top surface of the roofing membrane to insure that it will stay in position.

Thus, there still exists a need for a method and apparatus for adequately anchoring a roofing membrane to a roof deck wherein the membrane is not penetrated by any fastener.

SUMMARY OF THE INVENTION

The present invention provides an apparatus for securing an outer roofing membrane to an insulated roof structure having a rigid, flat bar anchor strip and a bar anchor tape having various layers thereon such as an optional primer, an adhesive, and an optional protective release layer.

In general, the present invention relates to a method of securing an outer roofing membrane to a roof deck comprising laying a strip of tape having successive coatings of an optional primer, an adhesive and a protective layer over the roof deck. Subsequently, the flat bar anchor is placed on the tape strip, fasteners are installed to secure the bar anchor and the tape to the roof deck and the protective layer is removed from the tape to expose the adhesive. An outer roofing membrane containing primer is laid over the adhesive on the tape so that the primer on the roofing membrane contacts the adhesive on the tape and thereby bonds the roofing membrane to the tape.

Another method for securing an outer roofing membrane to a roof deck is similar to the above method but wherein an additional seam tape is applied to the top of the bar anchor such that it is encapsulated.

Additionally, another method provides for securing the adjacent edges of two outer roofing membranes to a roof deck.

DETAILED DESCRIPTION OF THE INVENTION

Figure 1:
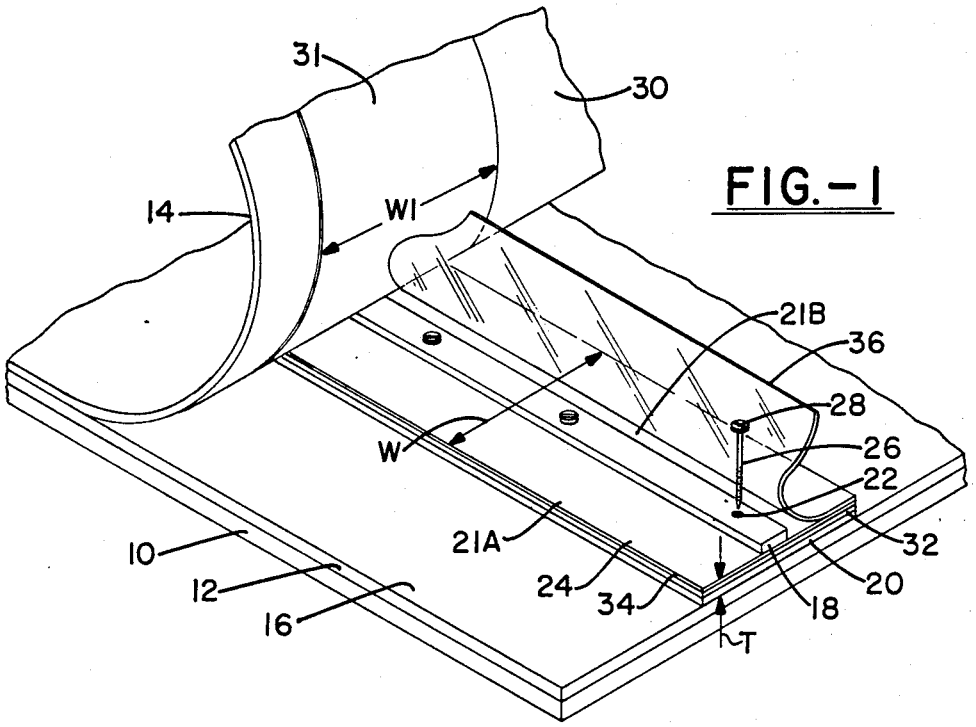
FIG. 1 is a perspective view of the preferred embodiment of applicant's apparatus and method for securing an outer roof membrane to a roof deck.

According to the concepts of the present invention, an apparatus and method is provided for securing an outer roofing membrane to a roof deck. A roof deck 10 which may be formed from sheets of plywood or any other approved material can optionally be overlayed with sheets of insulation 12. Examples of suitable insulation materials when utilized include polyurethane, polystyrene, wood fiberboard, fiberglass, and the like. Referring to FIG. 1 in which an insulated layer 12 is utilized, in order to seal the insulated roof deck, an outer roofing membrane 14 is applied to top surface 16 of the insulation layer. Applicant's apparatus for securing the outer roofing membrane 14 to the insulated roof deck 10 comprises a rigid, generally flat bar anchor strip 18 and a strip of bar anchor tape 20. Anchor strip 18 preferably is constructed of a prefabricated, 16 gauge, 1 inch wide, galvanized metal strip. However, it is to be understood that generally any suitable size or thickness of a bar anchor strip can be utilized. A plurality of fastener receiving bores 22 are formed at spaced intervals longitudinally along bar anchor strip 18.

Bar anchor tape 20 is generally formed of a suitable resilient material and desirably any conventional rubber material. A preferred resilient material is an ethylene-propylene-nonconjugated diene rubber (EPDM). Such EPDM rubber compounds are well known in the art as well as to the literature. In one embodiment, bar anchor tape 20 has a width W of approximately 5 inches and a thickness T of approximately 45 mils. Of course, various different widths and thicknesses can be utilized. The top surface 24 of bar anchor tape 20 contains successive layers generally of an optional primer 32, an adhesive 34 and usually but not necessarily a protective layer 36 such as a silicone release paper. Various primers can be utilized known to the art as well as to the literature which are effective with regard to a resilient rubber material. A preferred primer is a conventional isocyanate. The adhesive can be any suitable compound which generally adheres a resilient rubber layer such as EPDM rubber to a like outer roofing membrane. An example of such a preferred adhesive is butyl rubber. While the thickness of the primer layer is quite thin, the adhesive layer thickness can be from about 15 mils to about 60 mils, with about 35 mils being preferred.

The installation of the outer roofing membrane 14 is as follows. Referring to FIG. 1, the strip of bar anchor tape 20 is laid upon the insulation 12 of the insulated roof deck such that the silicone release paper faces upwardly. The rigid flat bar anchor strip 18 is then positioned centrally upon bar anchor tape 20 such that the tape is divided longitudinally into two parallel lateral strips or ribbons 21A and 21B of material of approximately equal width. Subsequently, fasteners 26 having screw-type heads 28 are installed through bores 22 in bar anchor strip 18 and driven sequentially through bar anchor tape 20, insulation layer 12 and into roof deck 10. In this manner, bar anchor strip 18, bar anchor tape 20 and insulation 12 are rigidly secured or affixed to roof deck 10. Subsequently, the silicon release paper is removed from the bar anchor tape 20 to expose the adhesive layer. Prior to laying outer roofing membrane 14 upon insulated roof deck 10, a longitudinally extending strip of an optional primer 31 is applied to the bottom surface 30 of membrane 14. The primer is generally the same as that applied to the bar anchor tape and hence preferably is an isocyanate primer. The primer strip is of sufficient width W1 (for example about 7 inches) to ensure that the strip will overlay the entire top surface 24 and particularly lateral strips of 21A and 21B of bar anchor tape 20. Thereafter, the outer roofing membrane 14 is laid upon the roof deck 10 and the bottom surface 30 is bonded to lateral strips 21A and 21B on top surface 24 of bar anchor tape 20 to secure the outer roofing membrane 14 to the insulated roof deck 10.

Figure 2:
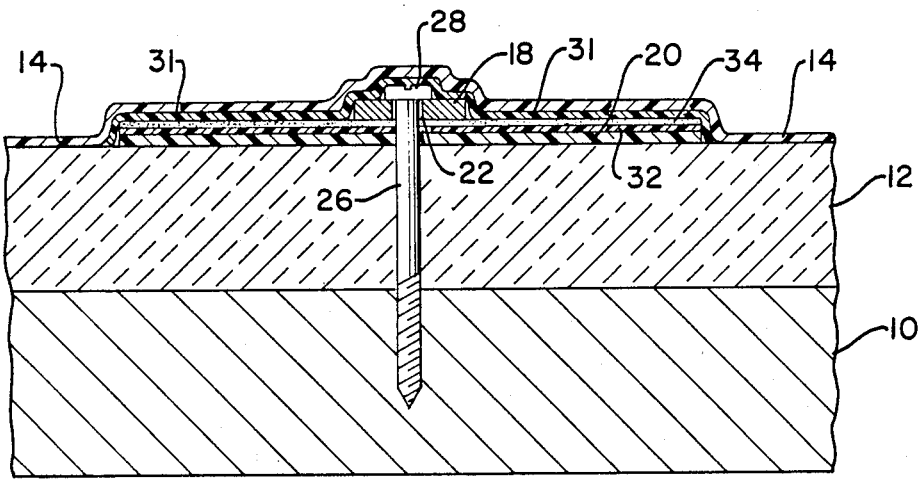
FIG. 2 is a cross-sectional view of the preferred embodiment of applicant's invention.
Figure 3:
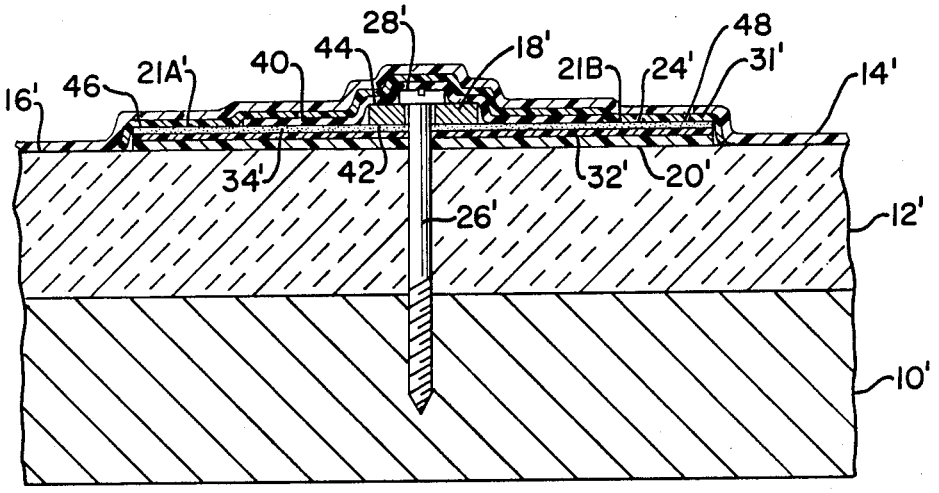
FIG. 3 illustrates a cross-sectional view of a second embodiment of applicant's apparatus and method for anchoring an outer roofing membrane to a roof deck.

In some installations, there may be concern that after the period of time the fastener heads 28 may penetrate the outer roofing membrane 14. In order to ensure that penetration of the outer membrane 14 does not occur, an optional layer of a seam adhesive tape 40 can be utilized to encapsulate the bar anchor strip 18 and the fastener heads 28 as seen by referring to FIG. 3. In FIG. 3, the elements which are identical to those of the preferred embodiment depicted in FIGS. 1 and 2 are identified by identical primed numbers. Accordingly, bar anchor tape 20' and generally rigid flat bar anchor strip 18' is described in detail in connection with the preferred embodiment depicted in FIGS. 1 and 2, and hence will not be repeated except to the extent that bar anchor tape 20' has an optional primer layer 32', and an adhesive layer 34', thereon. However, whereas bar anchor tape 20' is located between the bottom surface 42 of bar anchor strip 18' and insulation layer 12', the seam adhesive tape 40 is located between the top surface 44 of bar anchor strip 18' and the outer roofing membrane 14'. Seam tape 40 thus covers the heads 28' of the fasteners 26', overlies the entire top surface 44 of bar anchor strip 18' and extends partially to either side of bar anchor strip 18' to divide the top surface 24' of bar anchor tape 20' into two parallel and lateral strips of approximately equal width. Seam tape 40 can simply be a layer of an adhesive such as butyl rubber. To protect the adhesive from debris, both sides can be stored in silicone release paper which can be removed immediately before the seam tape 40 is applied to the top surface 24' of bar anchor tape 20'. Alternatively, seam tape 40 can be a rubber strip such as cured EPDM containing an adhesive layer such as butyl rubber on both sides thereof.

The method of securing the outer roofing membrane 14' to the insulated roof deck 10' according to the embodiment of applicant's invention depicted in FIG. 3 now will be explained. The first step comprises laying a longitudinally extending strip of bar cover tape 20' over the insulation and thereafter placing the rigid flat bar anchor strip 18' along the central longitudinal axis of the bar anchor tape 20' to provide the two lateral ribbons or strips 21A' and 21B' of bar anchor tape 20' on each side of bar anchor strip 18'. Subsequently, fasteners 26' are installed to secure the bar anchor strip 18' and the bar anchor tape 20' to the roof deck 10'. The silicone release paper is then removed. In practice, it has been found that the silicone release paper may be removed prior to the installation of the fasteners 26' as well as after. Subsequent to installation of the fasteners 26', seam adhesive tape 40 is applied such that the bottom surface 42 thereof overlies the bar anchor strip 18', the fasteners 26', and partially over bar anchor tape 20' to thereby divide the tape 20' into two parallel, longitudinally extending strips. Inasmuch as seam layer 40 is an adhesive layer, it can extend partially over the top of bar anchor tape 20' as shown or fully thereover. In fact, it can even extend beyond each lateral edge of anchor tape 20' such that it contacts the top of insulation 12' or roof 10'. In any event, it provides an adhesive surface such that outer roofing membrane 14' is adhered and secured thereto. An optional primer layer 31' such as an isocyanate primer can be applied to the bottom surface of outer roofing membrane 14'. This strip of primer has a width equal to or greater than the width of the bar anchor tape 20'. Subsequently, the outer roofing membrane 14' is laid upon the roof deck 10' such that the primer strip 31' applied to the bottom surface thereof overlies and engages seam adhesive 34' layer 40 as well as the adhesive exposed in strips 46 and 48 of the top surface of bar anchor tape 20'. Naturally, should seam adhesive layer 40 extend completely over bar anchor tape 20', there will be no exposed strips 46 and 48.

Figure 4:
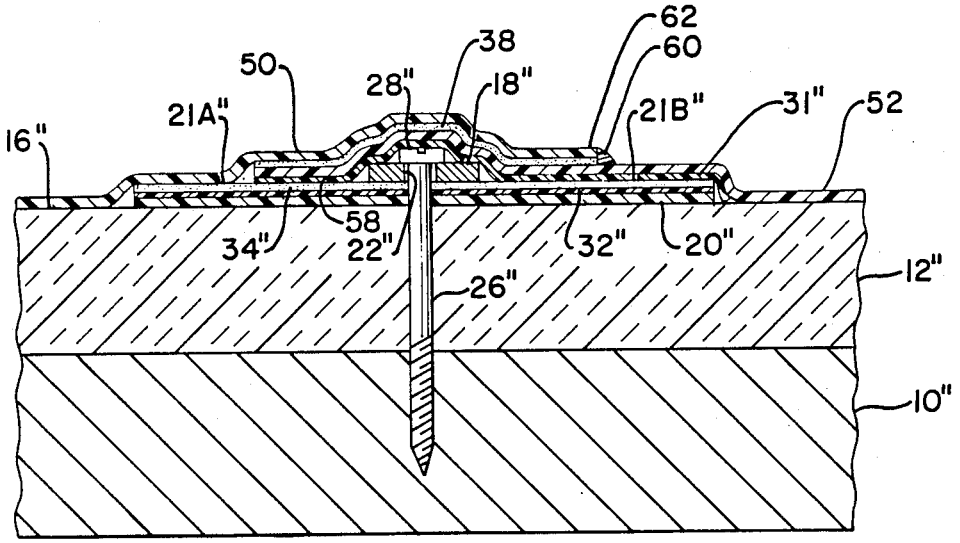
FIG. 4 is a cross-sectional view illustrating applicant's apparatus and method for securing an outer roofing membrane to a roof deck at the juncture of two adjacent roofing membrane pieces.

The apparatus and method for securing an outer roofing membrane to an insulated roof deck of the subject invention also may be utilized to accommodate the situation where two adjacent pieces of outer roofing membrane must be joined since normally it is not possible to make the outer roofing membrane from one piece of material. Considering FIG. 4, it can be seen that the method and apparatus utilized where two successive pieces of outer roofing membrane 50 and 52 are joined is substantially the same as that of the preferred embodiment depicted in FIGS. 1 and 2. Accordingly, where elements of the third embodiment depicted in FIG. 4 are identical to those of the preferred embodiment depicted in FIGS. 2 and 3, identical double primed numbers will be utilized. Referring to FIG. 4, the apparatus for securing the adjacent edges of two pieces 50 and 52 of an outer roofing membrane comprises a rigid flat bar anchor strip 18'' and a bar anchor tape 20'' which preferably have the same physical characteristics as described for those elements in connection with the preferred embodiment of the invention. Additionally, bar anchor strip 18" and bar anchor tape 20" are utilized in the same manner and for the same purposes as those elements are utilized in connection with the preferred embodiment.

The method of securing the adjacent edges of the two pieces 50 and 52 of outer roofing membrane is as follows. Initially, the strip of bar cover tape 20" having successive coatings of an optional primer 34", an adhesive 34" and an optional protective layer are placed upon the top surface 16" of insulation layer 12". Next, the flat bar anchor strip 18" is positioned in the center of bar anchor tape 20" to thereby divide the tape into two longitudinally extending ribbons or lateral strips 21A" and 21B". Fasteners 26" are installed in the bores 22" formed in anchor strip 18" and are driven through bar anchor tape 20", insulation layer 12" and into roof deck 10" to thereby secure the same. Thereafter, the protection layer of silicone release paper is removed from the top surface 24" of bar anchor tape 20". Subsequently, and if desired, an optional primer 31", for example, an isocyanate primer is applied along the bottom surface 58 adjacent the outer edge of membrane piece 50. Whether or not a primer is applied, an adhesive is applied to the top of outer membrane 52 and optionally to the bottom of membrane 50. This adhesive is generally a liquid since it forms a good seam adhesive and is less expensive than seam tape, although seam tape can be utilized. The liquid adhesive can be butyl rubber. Although referred to as being a liquid, it is understood that is has a viscosity such that it is viscous and does not generally run. The membrane piece 52 is laid upon the top surface 24" of bar anchor tape 20" such that it overlies the entire ribbon or strip 21B", the entire rigid flat bar anchor strip 18" and extends across a portion of ribbon or strip 21A", formed on the top surface 24". In this manner the bottom surface of membrane piece 52 becomes bonded to a major portion of the area on the top surface of bar anchor tape 20". Subsequently, the other piece of outer roofing membrane strip 50 is laid across the top of the exposed portion of ribbon 21A" of bar anchor tape 20" and the top surface of outer roofing membrane piece 52 and is adhered thereto. Thereafter, a bead of seam edge caulk 60 is applied at the end 62 of membrane piece 50 to provide a seal between this piece and the top surface of membrane piece 52.

It is to be understood that various aspects of the embodiment of FIG. 4 can be the same as set forth hereinabove. For example, the various outer membranes 50 and 52 can have a primer on an appropriate surface thereof. A release liner can also be contained on any outer membrane portion before the application thereof when it contains an adhesive thereon. Alternatively, the adhesive utilized between the layers naturally can be in the form of a laminate, that is a adhesive placed on both sides of a rubber layer such as EPDM to bond the two outer membranes together.

From the above, it may be seen that the subject invention provides an apparatus and method of securing an outer roofing membrane to an insulated roof deck having superior bonding properties such that additional anchoring or securing devices are unnecessary, that is easy to utilize and install and that is economical.

While in accordance with the Patent Statutes, a best mode and preferred embodiment has been set forth, the scope of the invention is not limited thereto, but rather by the scope of the attached claims.

What is claimed is:

1. A method of securing an EPDM rubber membrane to an insulated roof deck comprising the steps of:

laying a strip of EPDM rubber tape having successive coatings of an optional isocyanate primer, a butyl adhesive and a silicone release paper over said roof deck;

placing a bar anchor on said tape strip;

installing fasteners to secure said bar anchor and said tape strip to said roof;

removing said silicone release paper from said tape to expose said adhesive;

applying a strip of isocyanate primer to the bottom side of said membrane wherein said primer strip substantially overlies said adhesive on said tape; and laying an outer membrane on said roof deck such that said strip of primer on said membrane contacts said adhesive on said tape and thereby bonds said membrane to said tape.

2. A method of securing an outer membrane to a roof deck comprising the steps of:

laying a strip of a bar tape having successive coatings of an optional primer and, an adhesive over said roof deck;

placing a bar anchor on said bar tape so that a portion of said adhesive is exposed;

applying a seam adhesive tape to said bar anchor to bond said seam tape to said bar tape; and laying an outer membrane on said roof deck so that said membrane is bonded to at least said seam tape.

3. The method claim 2, wherein said bar tape, said seam tape, and said roofing membrane are made of cured EPDM rubber.

4. The method of claim 2, including securing said bar anchor to said roof deck.

5. The method of claim 4, including applying said seam tape over said bar anchor so that said bar anchor is encapsulated.

6. The method of claim 5, including applying a strip of primer to the bottom side of said membrane so that said primer strip substantially overlies said seam tape.

7. The method of claim 6, including a protective layer located on said bar tape adhesive, and including removing said protective layer from said bar tape to expose said adhesive prior to applying said roofing membrane thereof, and wherein said bar tape, and said roofing membrane are made of cured EPDM rubber.

8. The method of securing the adjacent edges of two pieces of an outer membrane to a roof deck comprising the steps of:

laying a strip of bar tape having an adhesive there on over said roof deck;

placing a bar anchor on said bar tape;

securing said bar anchor and said bar tape to said roof deck;

applying a first membrane to said bar tape so that it substantially overlies said adhesive on said bar tape and bonds said first membrane to said bar tape; and applying a second membrane on said roof deck such that it overlies the edge of said first membrane.

9. The method of claim 8, including placing an adhesive between said first membrane and said second membrane so that said second membrane is adhered to said first membrane.

10. The method of claim 9, including said bar tape having a protective layer thereon to substantially cover said adhesive, and removing said protective layer to expose said adhesive before applying said first membrane to said bar tape.

11. The method of claim 10, wherein said bar tape, said first membrane, and said second membrane are made from cured EPDM rubber.

12. An apparatus for securing a membrane to a roof, comprising:

a bar anchor tape having an adhesive layer on the upper surface thereof, a protective layer located on said adhesive layer, a rigid bar anchor, said bar anchor residing on said tape, said bar anchor fastened to the roof so that it secures said bar anchor to said roof.

13. An apparatus according to claim 12, including a rubber membrane, said rubber membrane covering said bar anchor, and said bar anchor tape having said protective layer removed therefrom, and said bar anchor tape being adhered to said rubber membrane.

14. An apparatus according to claim 13, wherein said bar anchor tape strip is a cured EPDM rubber, and wherein said bar anchor has a plurality of holes formed therein for the passage of the fasteners therethrough.

15. A rubber membrane secured to a roof, comprising:

a bar anchor tape positioned on a roof, a rigid bar anchor positioned on said bar tape and fastened to said roof;

a seam tape positioned on said rigid bar anchor and adhesively secured to said bar anchor tape; and a rubber membrane residing on said roof and adhesively secured to said seam tape.

16. A rubber membrane secured to a roof according to claim 15, wherein said roofing membrane is made of cured EPDM rubber.

17. A rubber membrane secured to a roof according to claim 16, wherein said bar anchor tape is made of cured EPDM rubber.

18. Adjacently joined roofing membranes secured to a roof, comprising:

a bar anchor tape positioned on a roof, a rigid bar anchor positioned on said bar tape and fastened to said roof;

a first rubber roof membrane overlying said bar anchor and adhered to said bar anchor tape; and a second adjacent rubber membrane positioned on said roof and overlying and adhered to a portion of said first rubber membrane overlying said bar anchor.

19. Adjacently joined roofing membranes secured to a roof according to claim 18, wherein said first rubber membrane and said second rubber membrane are made of cured EPDM rubber.

20. Adjacently joined roofing membranes secured to a roof according to claim 19, wherein said bar anchor tape is made of cured EPDM rubber.

21. A method of securing an outer roofing membrane to a roof deck, comprising the steps of:

providing a bar anchor tape having a primer on the upper side thereof and an adhesive layer on said primer, said bar anchor tape having a protective layer located on said adhesive layer;

laying said bar anchor tape over a roof deck;

placing a bar anchor on said bar anchor tape;

securing said bar anchor and said bar anchor tape to said roof deck;

removing said protective layer from said bar anchor tape, and laying a roof membrane over said bar anchor tape so that said roofing membrane is bonded to said bar anchor tape..

22. A method according to claim 21, including installing fasteners to secure said bar anchor and said bar anchor tape to said roof deck, and including applying a primer to at least a portion of said roofing membrane so that said roofing membrane primer contacts said adhesive layer on said bar anchor tape.

23. A method according to claim 22, including an insulation layer on said roof deck, and applying said bar anchor tape to said insulation.

24. A method according to claim 22, wherein said bar anchor tape is a cured EPDM rubber, wherein said roofing membrane is a cured EPDM rubber, wherein said protective layer is a silicone release paper, wherein said bar anchor tape adhesive is a butyl adhesive, and wherein said tape primer is an isocyanate type primer.

25. A method of securing an outer roofing membrane to a roof deck comprising the steps of:

providing a bar anchor tape having a continuous adhesive layer on the upper side thereof;

laying said bar anchor tape over a roof deck;

placing a bar anchor on said bar anchor tape;

securing said bar anchor and said bar anchor tape to said roof deck; and laying a roofing membrane over said bar anchor tape so that said roofing membrane is bonded to said adhesive layer bar anchor tape.

26. A method according to claim 25, including installing fasteners to secure said bar anchor and said bar anchor tape to said roof deck.

27. A method according to claim 26, wherein said bar anchor tape has a primer on the upper side thereof, wherein said continuous adhesive layer is located on said primer, including an insulation layer on said roof deck, and applying said bar anchor tape to said insulation.

28. A method according to claim 27, wherein said bar anchor tape is a cured EPDM rubber, and wherein said roofing membrane is a cured EPDM rubber, wherein said protective layer is a silicone release paper, wherein said bar anchor tape adhesive is a butyl adhesive, and wherein said tape primer is an isocyanate type primer.

* * * * *